US007220108B2

(12) United States Patent
Cho et al.

(10) Patent No.: US 7,220,108 B2
(45) Date of Patent: May 22, 2007

(54) VARIABLE CAPACITY ROTARY COMPRESSOR

(75) Inventors: Sung Hea Cho, Suwon (KR); Seung Kap Lee, Suwon (KR); Chun Mo Sung, Hwasung (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 473 days.

(21) Appl. No.: 10/845,193

(22) Filed: May 14, 2004

(65) Prior Publication Data

US 2005/0069442 A1 Mar. 31, 2005

(30) Foreign Application Priority Data

Sep. 30, 2003 (KR) ..... 10-2003-0068054

(51) Int. Cl.
*F04B 49/00* (2006.01)

(52) U.S. Cl. ..... 417/218; 417/221; 418/60

(58) Field of Classification Search ..... 417/218, 417/221; 418/60, 182, 210
See application file for complete search history.

(56) References Cited

U.S. PATENT DOCUMENTS 4,780,067 A 10/1988 Suzuki et al.
5,871,342 A 2/1999 Harte et al.
6,796,773 B1 * 9/2004 Choi et al. ..... 417/218
6,860,724 B2 * 3/2005 Cho et al. ..... 417/218
7,104,764 B2 * 9/2006 Lee et al. ..... 417/218
7,140,844 B2 * 11/2006 Lee et al. ..... 417/218
7,144,224 B2 * 12/2006 Kim et al. ..... 417/218
7,150,602 B2 * 12/2006 Choi et al. ..... 417/218
7,150,608 B2 * 12/2006 Cho et al. ..... 417/221
7,153,109 B2 * 12/2006 Cho et al. ..... 417/221

OTHER PUBLICATIONS

U.S. Appl. No. 10/352,000, filed Jan. 28, 2003, Sung-Hea Cho, et al.
Chinese Patent Office Action, mailed Nov. 28, 2006, and issued in corresponding Chinese Patent Application No. 200410047819X.

* cited by examiner

*Primary Examiner*—Michael Koczo, Jr.
(74) *Attorney, Agent, or Firm*—Staas & Halsey LLP

(57) ABSTRACT

A variable capacity rotary compressor including upper and lower compression chambers having different capacities, and a rotating shaft. Upper and lower eccentric cams are provided on the rotating shaft to be eccentric from the rotating shaft in a same direction. Upper and lower eccentric bushes are fitted over the upper and lower eccentric cams, respectively, to be eccentric from the rotating shaft in opposite directions, with a slot provided at a predetermined position between the upper and lower eccentric bushes. A locking pin functions to change a position of the upper or lower eccentric bush to a maximum eccentric position. A restraining unit is set along an edge of the slot to prevent the upper or lower eccentric bush from slipping. The restraining unit includes first and second elastic pieces which are respectively provided at positions adjacent to first and second ends of the slot.

17 Claims, 9 Drawing Sheets

VARIABLE CAPACITY ROTARY COMPRESSOR

CROSS-REFERENCE TO RELATED APPLICATIONS

This application claims the benefit of Korean Patent Application No. 2003-68054, filed Sep. 30, 2003 in the Korean Intellectual Property Office, the disclosures of which are incorporated herein by reference.

BACKGROUND OF THE INVENTION

1. Field of the Invention

The present invention relates, in general, to rotary compressors and, more particularly, to a variable capacity rotary compressor, in which is a compression operation is executed in either of two compression chambers having different capacities, by an eccentric unit mounted to a rotating shaft.

2. Description of the Related Art

Generally, a compressor is installed in a refrigeration system, such as an air conditioner and a refrigerator, which operates to cool air in a given space using a refrigeration cycle. In the refrigeration system, the compressor operates to compress a refrigerant which circulates through a refrigeration circuit. A cooling capacity of the refrigeration system is determined according to a compression capacity of the compressor. Thus, when the compressor is designed to vary a compression capacity thereof as desired, the refrigeration system may be operated under an optimum condition considering several factors, such as a difference between a practical temperature and a predetermined temperature, thus allowing air in a given space to be efficiently cooled, and saving energy.

A variety of compressors are used in the refrigeration system. The compressors are typically classified into two types, which are rotary compressors and reciprocating compressors. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be rotated over the eccentric cam.

The rotary compressor constructed as described above is operated as follows. As the rotating shaft rotates, the eccentric cam and the roller execute eccentric rotation in the compression chamber. At the time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor which is constructed so that a compression operation is executed in either of two compression chambers having different capacities by an eccentric unit mounted to a rotating shaft, thus varying a compression capacity as desired.

It is a further aspect of the present invention to provide a variable capacity rotary compressor, which prevents an eccentric bush from rotating faster than a rotating shaft in a specific range, due to variance in pressure of a compression chamber as the rotating shaft rotates.

It is an another aspect of the present invention to provide a variable capacity rotary compressor in which noise generated within the compressor as a result of parts collating with each other is reduced.

Additional aspects and/or advantages of the invention will be set forth in part in the description which follows and, in part, will be obvious from the description, or may be learned by practice of the invention.

The above and/or other aspects are achieved by a variable capacity rotary compressor, including upper and lower compression chambers, a rotating shaft, upper and lower eccentric cams, upper and lower eccentric bushes, a slot, a locking pin, and a restraining unit. The upper and lower compression chambers have different capacities. The rotating shaft passes through the upper and lower compression chambers. The upper and lower eccentric cams are provided on the rotating shaft. The upper and lower eccentric bushes are fitted over the upper and lower eccentric cams, respectively. The slot is provided at a predetermined position between the upper and lower eccentric bushes. The locking pin functions to change a position of the upper or lower eccentric bush to a maximum eccentric position, in cooperation with the slot. The restraining unit is provided at a predetermined position of the slot to restrain the locking pin with a predetermined elastic force when the locking pin is placed at a first or second end of the slot.

The restraining unit may include at each end thereof a pair of elastic pieces which are spaced apart from each other by a predetermined interval to restrain the locking pin with the predetermined elastic force.

The restraining unit may be set along an edge of the slot, and include an upper lip, a lower lip, and a pair of connecters which connects both ends of the upper and lower lips to each other.

The pair of elastic pieces may be provided at positions adjacent to each of the pair of connecters to be inwardly projected from the upper and lower lips, respectively.

The pair of elastic pieces may have an elastic force which is larger than a slip-rotating force of the upper and lower eccentric bushes but is smaller than a rotating force of the rotating shaft.

The upper lip may be provided with a first locking projection which is vertically upwardly projected from an inside end of the upper lip to be locked by the slot, and the lower lip may be provided with a second locking projection which is vertically downwardly projected from an inside end of the lower lip to be locked by the slot, to prevent the restraining unit from being removed from the slot.

Each of the pair of connecters may be provided with a third locking projection which is rearwardly projected from an inside end of the connecter to be locked by the slot, to prevent the restraining unit from moving in a horizontal direction.

The restraining unit may be fabricated through a pressing process to have a single structure.

The locking pin may be provided at a predetermined position between the upper and lower eccentric cams to be projected from the rotating shaft. The slot may be provided at the predetermined position between the upper and lower eccentric bushes to receive the locking pin therein, and may have a length to allow, an angle between a first line extending from the first end of the slot to a center of the rotating shaft and a second line extending from the second end of the slot to the center of the rotating shaft, to be 180°.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
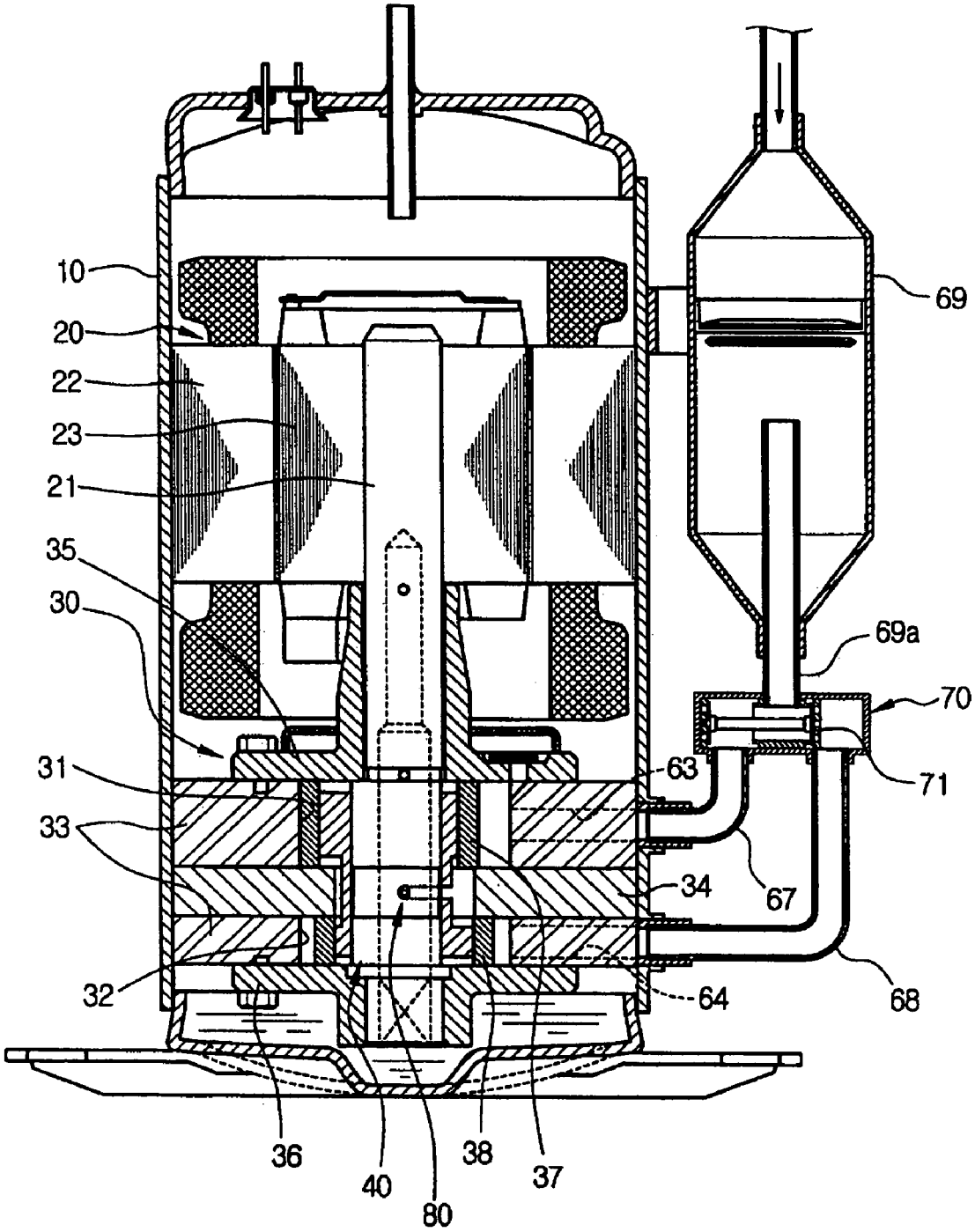
FIG. 1 is a sectional view to show an interior construction of a variable capacity rotary compressor, according to an embodiment of the present invention.

Reference will now be made in detail to the present preferred embodiment of the present invention, examples of which are illustrated in the accompanying drawings, wherein like reference numerals refer to like elements throughout. The embodiment is described below in order to explain the present invention by referring to the figures.

A variable capacity rotary compressor is explained in U.S. patent application Ser. No. 10/352,000, the content of which is incorporated herein by reference. Before presenting a detailed description of the present invention, the variable capacity rotary compressor is briefly discussed.

The construction of the variable capacity rotary compressor is as follows. The compressor includes first and second compression chambers. An eccentric unit is installed in the first and second compression chambers to execute the compression operation in either of the compression chambers, according to a rotating direction of a rotating shaft. The eccentric unit includes first and second eccentric cams, first and second eccentric bushes, first and second rollers, and a locking pin. The first and second eccentric cams are provided on an outer surface of the rotating shaft which passes through the first and second compression chambers. The first and second eccentric bushes are rotatably fitted over the first and second eccentric cams, respectively. The first and second rollers are rotatably fitted over the first and second eccentric bushes, respectively, to compress a gas refrigerant. The locking pin is installed to change a position of one of the first and second eccentric bushes to a position eccentric from a central axis of the rotating shaft, while changing a position of a remaining one of the first and second eccentric bushes to a position concentric with the central axis of the rotating shaft, according to the rotating direction of the rotating shaft.

Thus, when the rotating shaft rotates in a first direction which is counterclockwise in the drawings or a second direction which is clockwise in the drawings, the compression operation is executed in either of the first and second compression chambers having different capacities by the eccentric unit constructed as described above, thus varying the compression capacity of the compressor as desired.

A detailed description of the present invention is now presented.

FIG. 1 is a sectional view to show a variable capacity rotary compressor, according to an embodiment of the present invention. As shown in FIG. 1, the variable capacity rotary compressor includes a hermetic casing 10, with a driving unit 20 and a compressing unit 30 being installed in the hermetic casing 10. The driving unit 20 generates a rotating force, and the compressing unit 30 compresses gas using the rotating force of the driving unit 20. The driving unit 20 includes a cylindrical stator 22, a rotor 23, and a rotating shaft 21. The stator 22 is fixedly mounted to an inner surface of the hermetic casing 10. The rotor 23 is rotatably installed in the stator 22. The rotating shaft 21 is installed to pass through a center of the rotor 23, and rotates along with the rotor 23 in a first direction which is counterclockwise in the drawings or in a second direction which is clockwise in the drawings.

The compressing unit 30 includes a housing 33, upper and lower flanges 35 and 36, and a partition 34. The housing 33 defines upper and lower compression chambers 31 and 32, which are both cylindrical but have different capacities, therein. The upper and lower flanges 35 and 36 are mounted to upper and lower ends of the housing 33, respectively, to rotatably support the rotating shaft 21. The partition 34 is interposed between the upper and lower compression chambers 31 and 32 to partition the upper and lower compression chambers 31 and 32 from each other.

The upper compression chamber 31 is taller than the lower compression chamber 32, thus the upper compression chamber 31 has a larger capacity than the lower compression chamber 32. Therefore, a larger amount of gas is compressed in the upper compression chamber 31 in comparison with the lower compression chamber 32, thus allowing the rotary compressor to have a variable capacity.

Meanwhile, when the lower compression chamber 32 is taller than the upper compression chamber 31, the lower compression chamber 32 has a larger capacity than the upper compression chamber 31, to allow a larger amount of gas to be compressed in the lower compression chamber 32.

Further, an eccentric unit 40 is placed in the upper and lower compression chambers 31 and 32 to execute a compressing operation in either the upper or lower compression chamber 31 and 32, according to a rotating direction of the rotating shaft 21. According to the present invention, a restraining unit 80 is provided at a predetermined position of the eccentric unit 40 to allow the eccentric unit 40 to be smoothly operated without slippage. The construction and operation of the eccentric unit 40 and the restraining unit 80 will be described later herein, with reference to FIGS. 2 to 8.

Upper and lower rollers 37 and 38 are placed in the upper and lower compression chambers 31, respectively, to be rotatably fitted over the eccentric unit 40. The upper inlet and outlet 63 and 65 (refer to FIG. 6) are formed at predetermined positions of the housing 33 to communicate with the upper compression chamber 31. The lower inlet and outlet 64 and 66 (refer to FIG. 8) are formed at predetermined positions of the housing 33 to communicate with the lower compression chamber 32.

Figure 6:
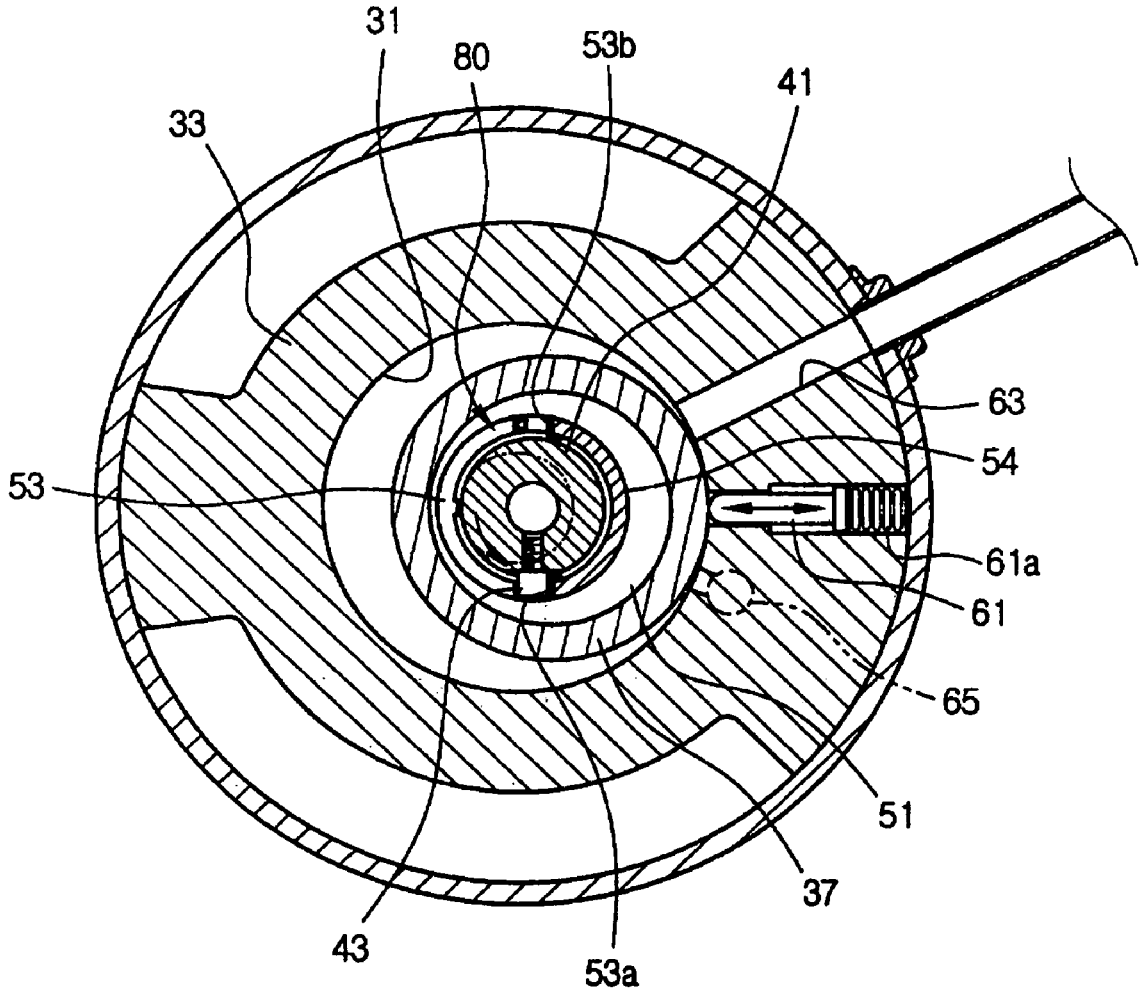
FIG. 6 is a sectional view to show an upper compression chamber where a compression operation is executed without slippage by the eccentric unit of FIG. 2, when the rotating shaft rotates in the first direction.

An upper vane 61 is positioned between the upper inlet and outlet 63 and 65, and is biased in a radial direction by an upper support spring 61*a* to be in close contact with the upper roller 37 (refer to FIG. 6). Further, a lower vane 62 is positioned between the lower inlet and outlet 64 and 66, and is biased in a radial direction by a lower support spring 62*a* to be in close contact with the lower roller 38 (refer to FIG. 8).

A refrigerant outlet pipe 69*a* extends from an accumulator 69 which contains a refrigerant therein. Of the refrigerant contained in the accumulator 69, only a gas refrigerant flows into the compressor through the refrigerant outlet pipe 69*a*. A path controller 70 is included at a predetermined position of the refrigerant outlet pipe 69*a*. The path controller 70 opens an intake path 67 or 68 to supply the gas refrigerant to the upper or lower inlet 63 or 64 of the upper or lower compression chamber 31 or 32 in which a compression operation is executed. A valve 71 is installed in the path controller 70 to be movable in a horizontal direction. The valve 71 opens either the intake paths 67 or 68 by a difference in pressure between the intake path 67 connected to the upper inlet 63 and the intake path 68 connected to the lower inlet 64 to supply the gas refrigerant to the upper inlet 63 or lower inlet 64.

The construction of the rotating shaft 21, the eccentric unit 40, and the restraining unit 80 according to an embodiment of the present invention will be described in the following with reference to FIGS. 2 and 3.

Figure 2:
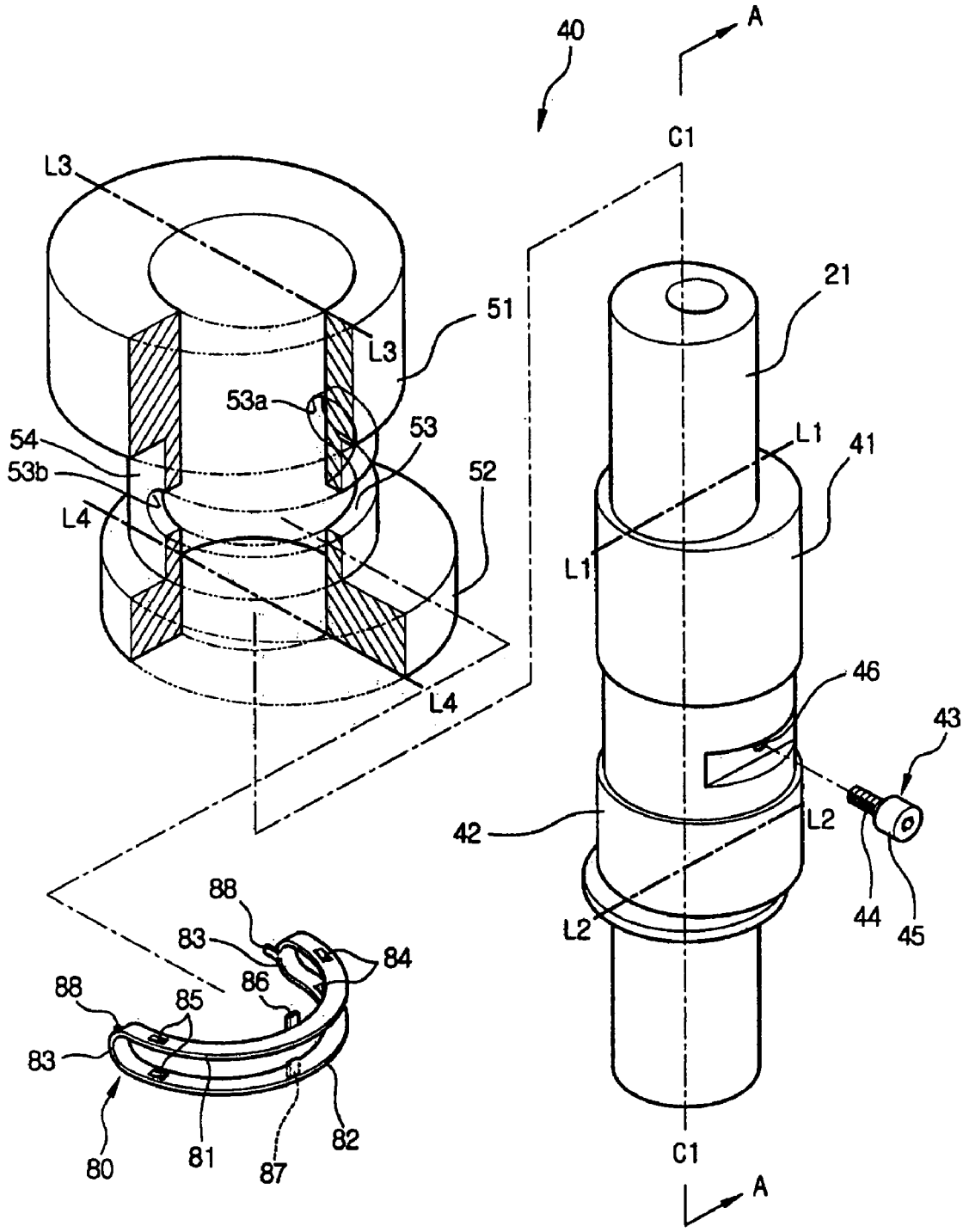
FIG. 2 is a perspective view of an eccentric unit included in the compressor of FIG. 1, in which upper and lower eccentric bushes of the eccentric unit are separated from a rotating shaft.

FIG. 2 is a perspective view of the eccentric unit included in the compressor of FIG. 1, in which upper and lower eccentric bushes of the eccentric unit are separated from the rotating shaft. FIG. 3 is a perspective view to show the restraining unit fitted into the eccentric unit of FIG. 2.

As shown in FIG. 2, the eccentric unit 40 includes upper and lower eccentric cams 41 and 42. The upper and lower eccentric cams 41 and 42 are provided on the rotating shaft 21 to be placed in the upper and lower compression chambers 31 and 32, respectively. The upper and lower eccentric bushes 51 and 52 are fitted over the upper and lower eccentric cams 41 and 42, respectively. A locking pin 43 is provided at a predetermined position between the upper and lower eccentric cams 41 and 42. A slot 53 of a predetermined length is provided at a predetermined position between the upper and lower eccentric bushes 51 and 52 to engage with the locking pin 43. The eccentric unit 40 also includes the restraining unit 80. The restraining unit 80 prevents the upper or lower eccentric bush 51 or 52 from slipping over the upper or lower eccentric cam 41 or 42 at a predetermined position.

The upper and lower eccentric cams 41 and 42 are integrally fitted over the rotating shaft 21 to be eccentric from the central axis C1—C1 of the rotating shaft 21. The upper and lower eccentric cams 41 and 42 are positioned to correspond an upper eccentric line L1—L1 of the upper eccentric cam 41 to a lower eccentric line L2—L2 of the lower eccentric cam 42. In this case, the upper eccentric line L1—L1 is defined as a line to connect a maximum eccentric part of the upper eccentric cam 41, which is maximally projected from the rotating shaft 21, to a minimum eccentric part of the upper eccentric cam 41, which is minimally projected from the rotating shaft 21. Meanwhile, the lower eccentric line L2—L2 is defined as a line to connect a maximum eccentric part of the lower eccentric cam 42, which is maximally projected from the rotating shaft 21, to a minimum eccentric part of the lower eccentric cam 42, which is minimally projected from the rotating shaft 21.

The locking pin 43 includes a threaded shank 44 and a head 45. The head 45 has slightly larger diameter than the shank 44, and is formed at an end of the shank 44. Further, a threaded hole 46 is formed on the rotating shaft 21 between the upper and lower eccentric cams 41 and 42 to be at about 90° with the maximum eccentric parts of the upper and lower eccentric cams 41 and 42. The threaded shank 44 of the locking pin 43 is inserted into the threaded hole 46 in a screw-fastening method to lock the locking pin 43 to the rotating shaft 21.

The upper and lower eccentric bushes 51 and 52 are integrated with each other by a connecting part 54 which connects the upper and lower eccentric bushes 51 and 52 to each other. The slot 53 is formed around a part of the connecting part 54, and has a slightly larger width than a diameter of the head 45 of the locking pin 43.

Thus, when the upper and lower eccentric bushes 51 and 52 which are integrally connected to each other by the connecting part 54 are fitted over the rotating shaft 21 and the locking pin 43 is inserted to the threaded hole 46 of the rotating shaft 21 through the slot 53, the locking pin 43 is mounted to the rotating shaft 21 while engaging with the slot 53.

When the rotating shaft 21 rotates in the first or second direction in such a state, the locking pin 43 comes into contact with the first or second end 53*a* or 53*b* of the slot 53 and causes the upper and lower eccentric bushes 51 and 52 rotate in the first or second direction along with the rotating shaft 21.

In this case, an eccentric line L3—L3, which connects the maximum eccentric part of the upper eccentric bush 51 to the minimum eccentric part thereof, is placed at about 90° with a line which connects the first end 53*a* of the slot 53 to a center of the connecting part 54. Meanwhile, an eccentric line L4—L4, which connects the maximum eccentric part of the lower eccentric bush 52 to the minimum eccentric part thereof, is placed at about 90° with a line which connects the second end 53*b* of the slot 53 to the center of the connecting part 54.

Further, the eccentric line L3—L3 of the upper eccentric bush 51 and the eccentric line L4—L4 of the lower eccentric bush 52 are positioned on a same plane, but the maximum eccentric part of the upper eccentric bush 51 is arranged to be opposite to the maximum eccentric part of the lower eccentric bush 52. An angle between a line extending from the first end 53*a* of the slot 53 to a center of the rotating shaft 21 and a line extending from the second end 53*b* of the slot 53 to the center of the rotating shaft 21 is 180°. The slot 53 is formed around a part of the connecting part 54.

When the locking pin 43 is locked by the first end 53*a* of the slot 53 and the upper eccentric bush 51 rotates along with the rotating shaft 21 in the first direction (of course, the lower eccentric bush 52 also rotates), the maximum eccentric part of the upper eccentric cam 41 contacts the maximum eccentric part of the upper eccentric bush 51. Thus, the upper eccentric bush 51 rotates along with the rotating shaft 21 in the first direction while being maximally eccentric from the rotating shaft 21 (refer to FIG. 6). Meanwhile, in the case of the lower eccentric bush 52, the maximum eccentric part of the lower eccentric cam 42 contacts the minimum eccentric part of the lower eccentric bush 52. Thus, the lower eccentric bush 52 rotates along with the rotating shaft 21 in the first direction while being concentric with the rotating shaft 21 (refer to FIG. 7).

When the locking pin 43 is locked by the second end 53*b* of the slot 53 and the lower eccentric bush 52 rotates along with the rotating shaft 21 in the second direction, the maximum eccentric part of the lower eccentric cam 42 contacts the maximum eccentric part of the lower eccentric bush 52. Thus, the lower eccentric bush 51 rotates along with the rotating shaft 21 in the second direction while being maximally eccentric from the rotating shaft 21 (refer to FIG. 8). Meanwhile, in the case of the upper eccentric bush 51, the maximum eccentric part of the upper eccentric cam 41 contacts the minimum eccentric part of the upper eccentric bush 51. Thus, the upper eccentric bush 51 rotates along with the rotating shaft 21 in the second direction while being concentric with the rotating shaft 21 (refer to FIG. 9).

The restraining unit 80 is provided at the predetermined position of the eccentric unit 40 which is constructed as described above, to allow the upper and lower eccentric bushes 51 and 52 to rotate at a same speed as the rotating shaft 21 without slippage. The restraining unit 80 is made of a ring-shaped thin plate. The ring-shaped thin plate is folded to have a similar shape as an edge of the slot 53, and then is fitted into the slot 53. After the restraining unit 80 is fitted into the slot 53, the locking pin 43 is fastened to the rotating shaft 21 through the slot 53.

According to the present invention, the restraining unit 80 includes upper and lower lips 81 and 82 which come into contact with the edge of the slot 53. The restraining unit 80 also includes a pair of connecters 83 which connect opposite ends of the upper and lower lips 81 and 82 to each other. The restraining unit 80 further includes a pair of first elastic pieces 84 which are provided at positions adjacent to one of the connecters 83 to be inwardly projected from the upper and lower lips 81 and 82. Further, a pair of second elastic pieces 85 are provided at positions adjacent to a remaining one of the connecters 83 to be inwardly projected from the upper and lower lips 81 and 82.

The upper and lower lips 81 and 82, the connecters 83, and the first and second elastic pieces 84 and 85 are integrated with each other into a single structure, through a pressing process or other processes, to have a predetermined elastic force. Thus, when the restraining unit 80 is fitted into the slot 53 while the upper and lower lips 81 and 82 are slightly compressed, as shown in FIG. 3, the upper lip 81 comes into close contact with the upper edge of the slot 53, and the lower lip 82 comes into close contact with the lower edge of the slot 53. Further, the pair of connecters 83, respectively, come into close contact with the first and second ends 53*a* and 53*b* of the slot 53.

At positions adjacent to the first end 53*a* of the slot 53, the upper and lower lips 81 and 82 are cut and bent to form the pair of first elastic pieces 84. The pair of first elastic pieces 84 are placed to be spaced apart from each other by a predetermined interval, to elastically restrain or release the locking pin 43. Thus, when the rotating shaft 21 rotates in the first direction and the locking pin 43 moves to the first end 53*a* of the slot 53, the locking pin 43 is elastically restrained by the pair of first elastic pieces 84.

Similarly, at positions adjacent to the second end 53*b* of the slot 53, the upper and lower lips 81 and 82 are cut and bent to form the pair of second elastic pieces 85. The pair of second elastic pieces 85 are placed to be spaced apart from each other by a predetermined interval, to elastically restrain or release the locking pin 43. Thus, when the rotating shaft 21 rotates in the second direction and the locking pin 43 moves to the second end 53*b* of the slot 53, the locking pin 43 is elastically restrained by the pair of second elastic pieces 85.

Further, a first locking projection 86 is vertically upwardly projected from a center of an inside end of the upper lip 81, and a second locking projection 87 is vertically downwardly projected from a center of an inside end of the lower lip 82, and a third locking projection 88 is rearwardly projected from an inside end of each of the connecters 83, to allow the restraining unit 80 to be securely fitted into the slot 53.

Figure 3:
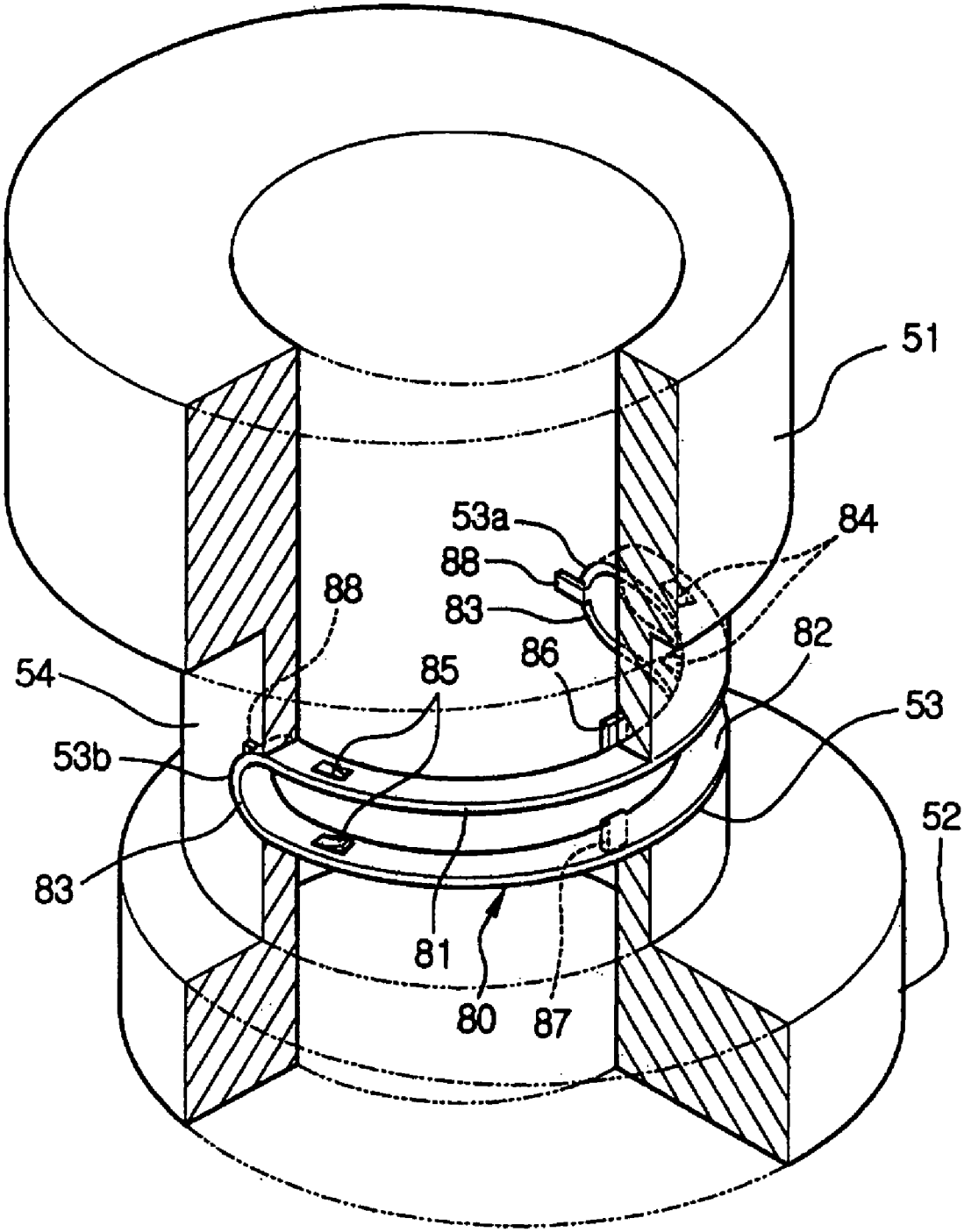
FIG. 3 is a perspective view to show a restraining unit fitted into the eccentric unit of FIG. 2.

As shown in FIG. 3, when the restraining unit 80 is fitted into the slot 53 while slightly compressing the upper and lower lips 81 and 82, the first and second locking projections 86 and 87 are respectively locked by the upper and lower edges of the slot 53 to prevent the restraining unit 80 from being undesirably removed from the slot 53. The third locking projections 88 inwardly extend from the first and second ends 53*a* and 53*b* of the slot 53, respectively, to prevent the restraining unit 80 from moving to right and left.

The pair of first elastic pieces 84 and the pair of second elastic pieces 85 have an elastic force which is larger than a slip-rotating force of the upper and lower eccentric bushes 51 and 52 but is smaller than a rotating force of the rotating shaft 21. As the rotating shaft 21 rotates, the locking pin 43 moves to be restrained by or released from the first and second elastic pieces 84 and 85. Conversely, when the upper or lower eccentric bush 51 or 52 respectively slips over the upper or lower eccentric cam 41 or 42, the locking pin 43 is restrained by the first or second elastic pieces 84 or 85 to allow the upper or lower eccentric bush 51 and 52 to rotate at the same speed as the rotating shaft 21 without slipping over the upper or lower eccentric cam 41 and 42, respectively.

The operation of compressing a gas refrigerant in the upper or lower compression chamber by the eccentric unit according to an embodiment of the present invention will be described in the following with reference to FIGS. 4 to 9.

Figure 4:
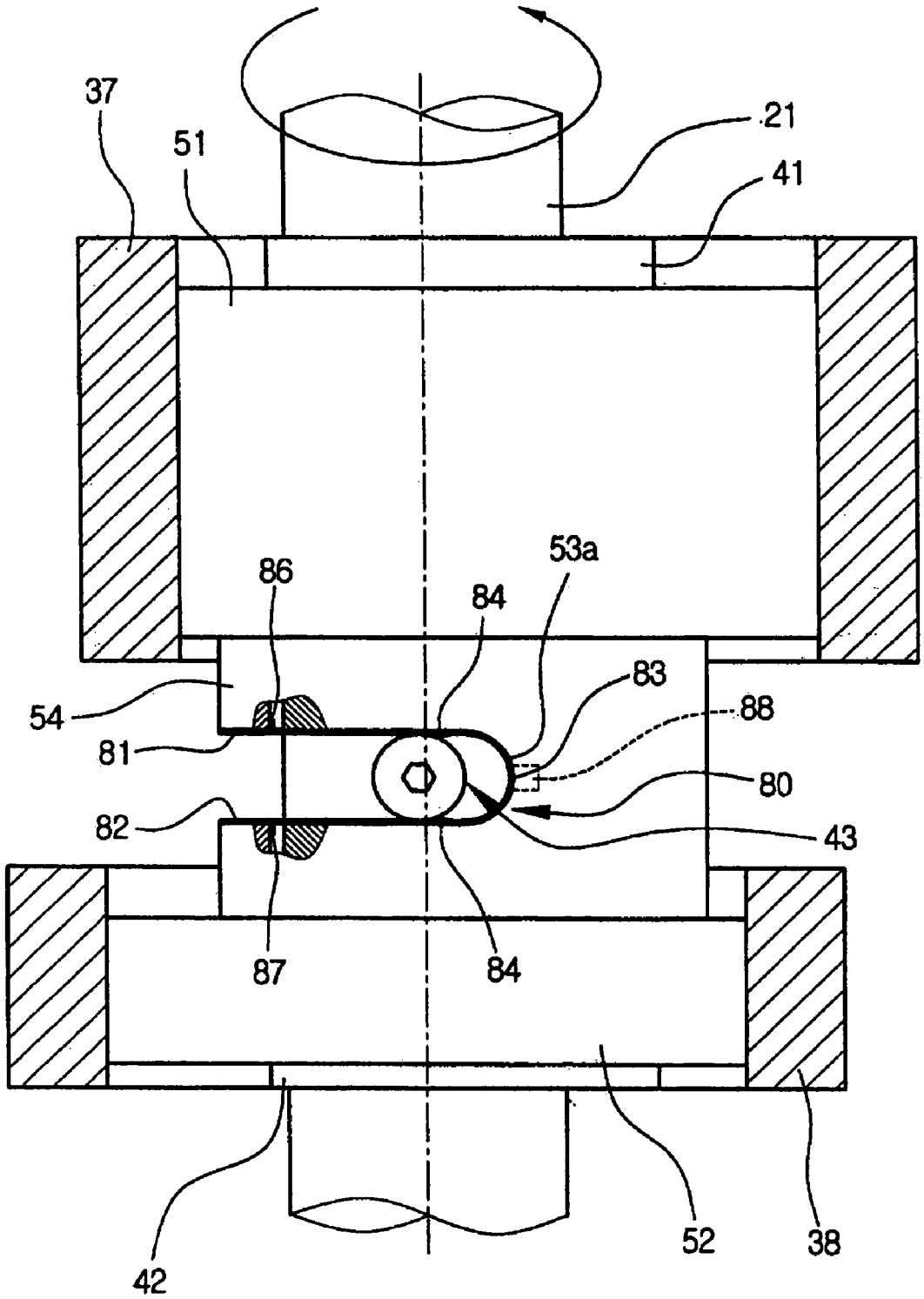
FIG. 4 is a sectional view taken along a line A—A of FIG. 2 to show a state immediately before a locking pin is restrained by the restraining unit of FIG. 3 as the rotating shaft rotates in a first direction.
Figure 5:
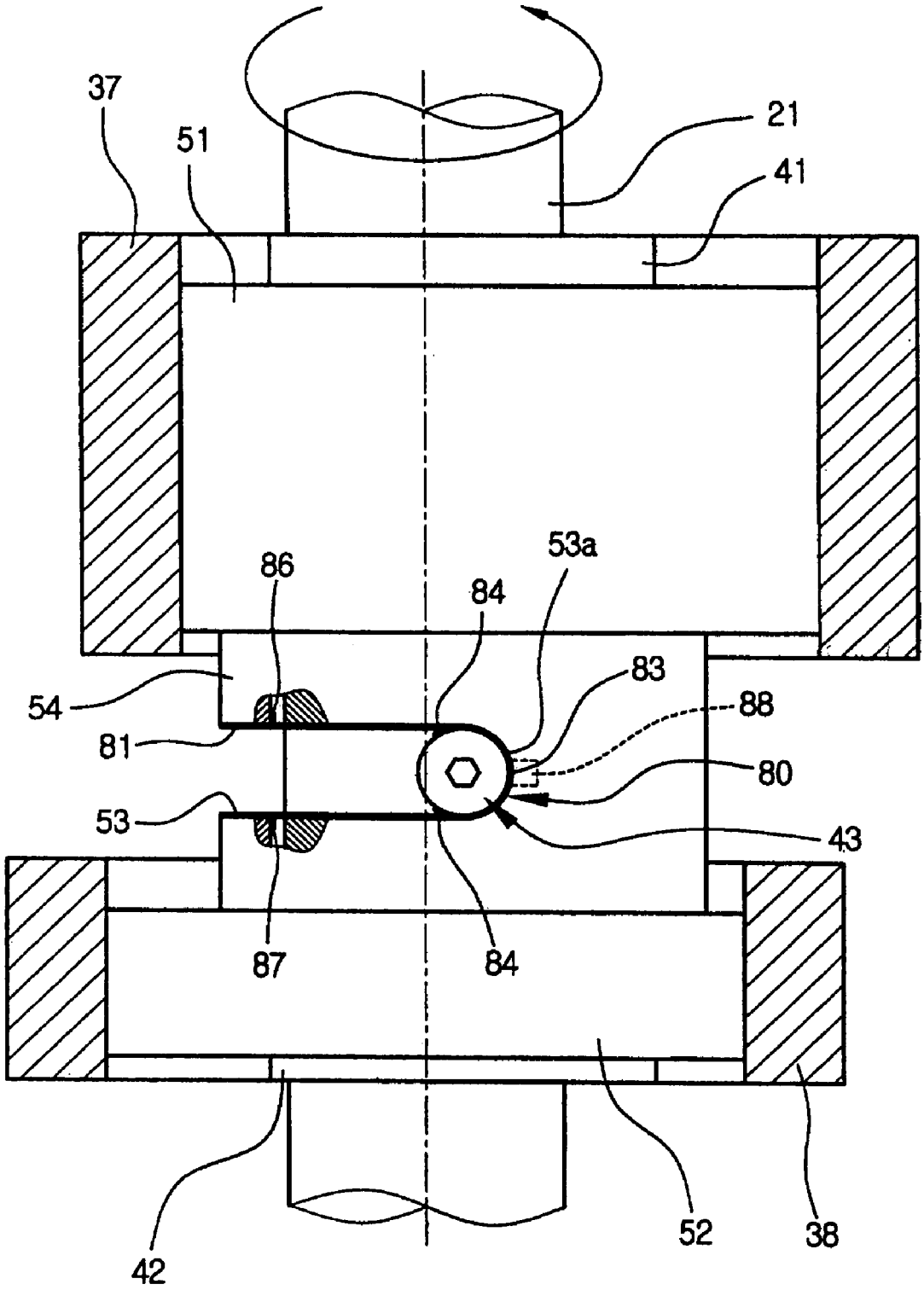
FIG. 5 is a sectional view taken along the line A—A of FIG. 2 to show a state when the locking pin is restrained by the restraining unit of FIG. 3 as the rotating shaft rotates in the first direction.
Figure 7:
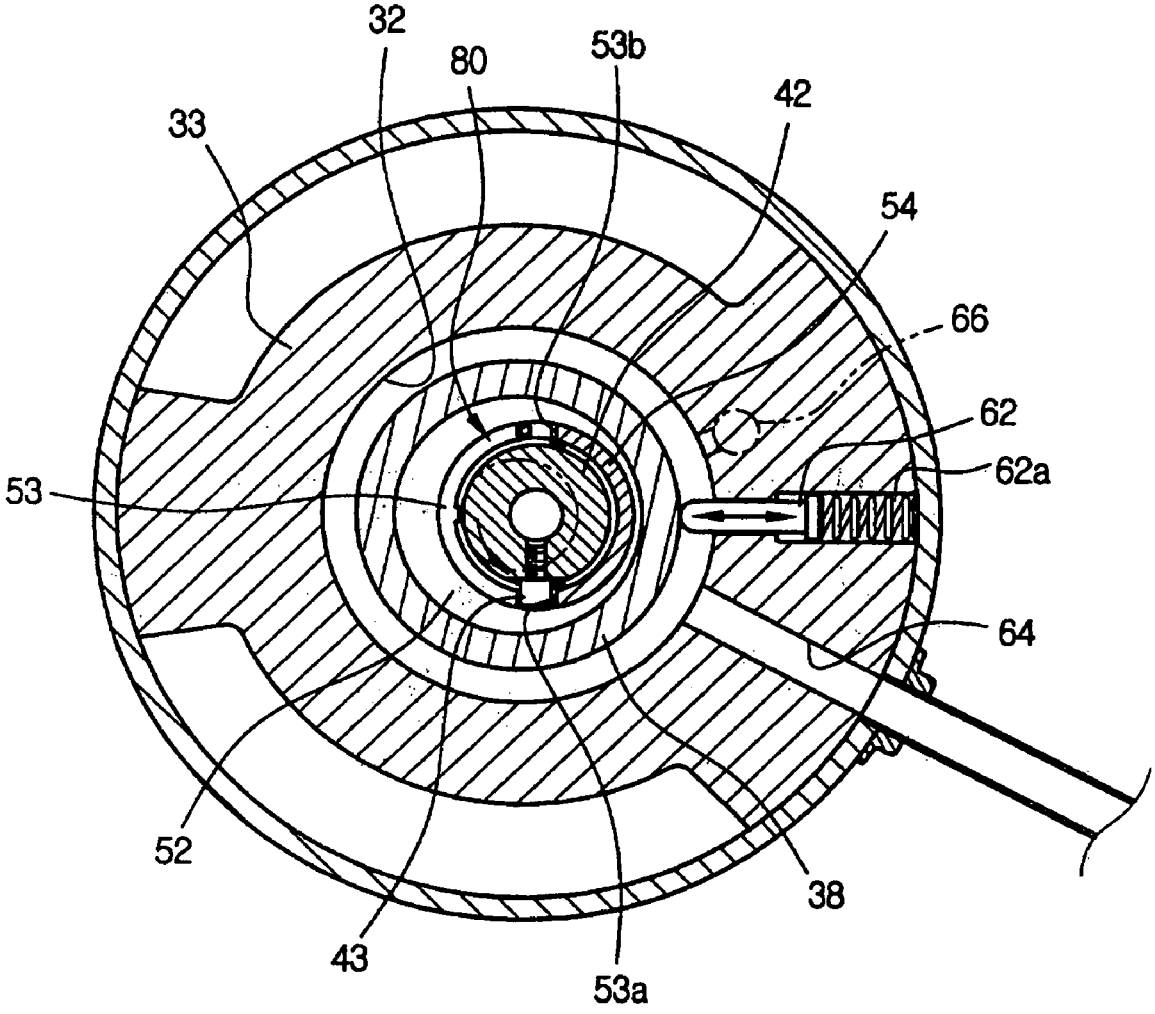
FIG. 7 is a sectional view, corresponding to FIG. 6, to show a lower compression chamber where an idle operation is executed by the eccentric unit of FIG. 2, when the rotating shaft rotates in the first direction.

FIG. 4 shows a state immediately before the moment when the locking pin 43 is restrained by the restraining unit 80 as the rotating shaft 21 rotates in the first direction. FIG. 5 shows a state when the locking pin 43 is restrained by the restraining unit 80 as the rotating shaft 21 rotates in the first direction. FIG. 6 shows the upper compression chamber 31 where the compression operation is executed without slippage by the eccentric unit 40, when the rotating shaft 21 rotates in the first direction. FIG. 7 is a sectional view, corresponding to FIG. 6, to show the lower compression chamber where the idle operation is executed by the eccentric unit 40, when the rotating shaft 21 rotates in the first direction.

As shown in FIG. 4, when the rotating shaft 21 rotates in the first direction, which in this case is counterclockwise, in FIG. 6, the locking pin 43, projected from the rotating shaft 21, is guided within the slot 53, in which the restraining unit 80 is fitted, to move toward the first end 53*a* of the slot 53. By the movement of the locking pin 43, the locking pin 43 moves close to the first elastic pieces 84 of the restraining unit 80, which are provided adjacent to the first end 53*a* of the slot 53. When the locking pin 43 further moves in a same direction, the head 45 of the locking pin 43 passes between the first elastic pieces 84 to be inserted into a position between the first elastic pieces 84 and a corresponding connecter 83.

When the locking pin 43 passes between the first elastic pieces 84, the first elastic pieces 84 are elastically deformed. Thereafter, as shown in FIG. 4, the locking pin 43 is inserted into the position between the first elastic pieces 84 and the corresponding connecter 83. After the locking pin 43 has passed between the first elastic pieces 84, the first elastic pieces 84 are elastically restored to original states to restrain the locking pin 43 with a predetermined elastic force.

When the locking pin 43 is restrained by the first elastic pieces 84 with the predetermined elastic force so as to be held at the first end 53*a* of the slot 53, the maximum eccentric part of the upper eccentric cam 41 contacts the maximum eccentric part of the upper eccentric bush 51. The upper eccentric bush 51 rotates while being maximally eccentric from the central axis C1—C1 of the rotating shaft 21. Thus, as shown in FIG. 6, the upper roller 37 rotates while being in contact with an inner surface of the housing 33 which defines the upper compression chamber 31, to execute the compression operation.

Simultaneously, the maximum eccentric part of the lower eccentric cam 42 contacts the minimum eccentric part of the lower eccentric bush 52. The lower eccentric bush 52 rotates while being concentric with the central axis C1—C1 of the rotating shaft 21. Thus, as shown in FIG. 7, the lower roller 38 rotates while being spaced apart from the inner surface of the housing 33, which defines the lower compression chamber 32, by a predetermined interval. As a result, the compression operation is not executed.

When the rotating shaft 21 rotates in the first direction, the gas refrigerant flowing to the upper compression chamber 31 through the upper inlet 63 is compressed by the upper roller 37 in the upper compression chamber 31 having a larger capacity, and subsequently is discharged from the upper compression chamber 31 through the upper outlet 65. On the other hand, the compression operation is not executed in the lower compression chamber 32 having a smaller capacity. Therefore, the rotary compressor is operated in a larger capacity compression mode.

Meanwhile, as shown in FIG. 6, when the upper roller 37 comes into contact with the upper vane 61, the operation of compressing the gas refrigerant is completed and an operation of drawing the gas refrigerant is started. At this time, some of the compressed gas, which was not discharged from the upper compression chamber 31 through the upper outlet 65, returns to the upper compression chamber 31 and expands again to apply a pressure to the upper roller 37 and the upper eccentric bush 51 in a rotating direction of the rotating shaft 21.

If the upper eccentric bush 51 rotates faster than the rotating shaft 21, the upper eccentric bush 51 slips over the upper eccentric cam 41. When the rotating shaft 21 further rotates in such a state, the locking pin 43 collides with the first end 53*a* of the slot 53 to make the upper eccentric bush 51 rotate at a same speed as that of the rotating shaft 21. Noise may be generated and the locking pin 43 and the slot 53 may be damaged, due to the collision between the locking pin 43 and the slot 53.

However, the eccentric unit 40 according to the present invention prevents the upper eccentric bush 51 from slipping by the operation of the restraining unit 80.

When the upper roller 37 comes into contact with the upper vane 61, some of the gas refrigerant returns to the upper compression chamber 31 through the upper outlet 65 and expands again, to generate a pressure. The pressure acts on the upper eccentric bush 51 in the rotating direction of the rotating shaft 21 which is the first direction, thus the upper eccentric bush 51 slips over the upper eccentric cam 41. However, as shown in FIG. 5, the locking pin 43 is restrained by the first elastic pieces 84 of the restraining unit 80 which are provided at positions adjacent to the first end 53*a* of the slot 53, with the elastic force which is larger than the slip-rotating force of the upper eccentric bush 51 to allow the upper eccentric bush 51 to rotate at the same speed as the rotating shaft 21 without the slippage.

To execute the compression operation in the lower compression chamber 32 after the upper eccentric bush 51 has executed the compression operation in the upper compression chamber 31 without the slippage, the rotating shaft 21 is stopped to change the rotating direction thereof to the second direction. The compression operation executed in the lower compression chamber 32 will be described in the following with reference to FIGS. 4, 5, 8, and 9.

Figure 8:
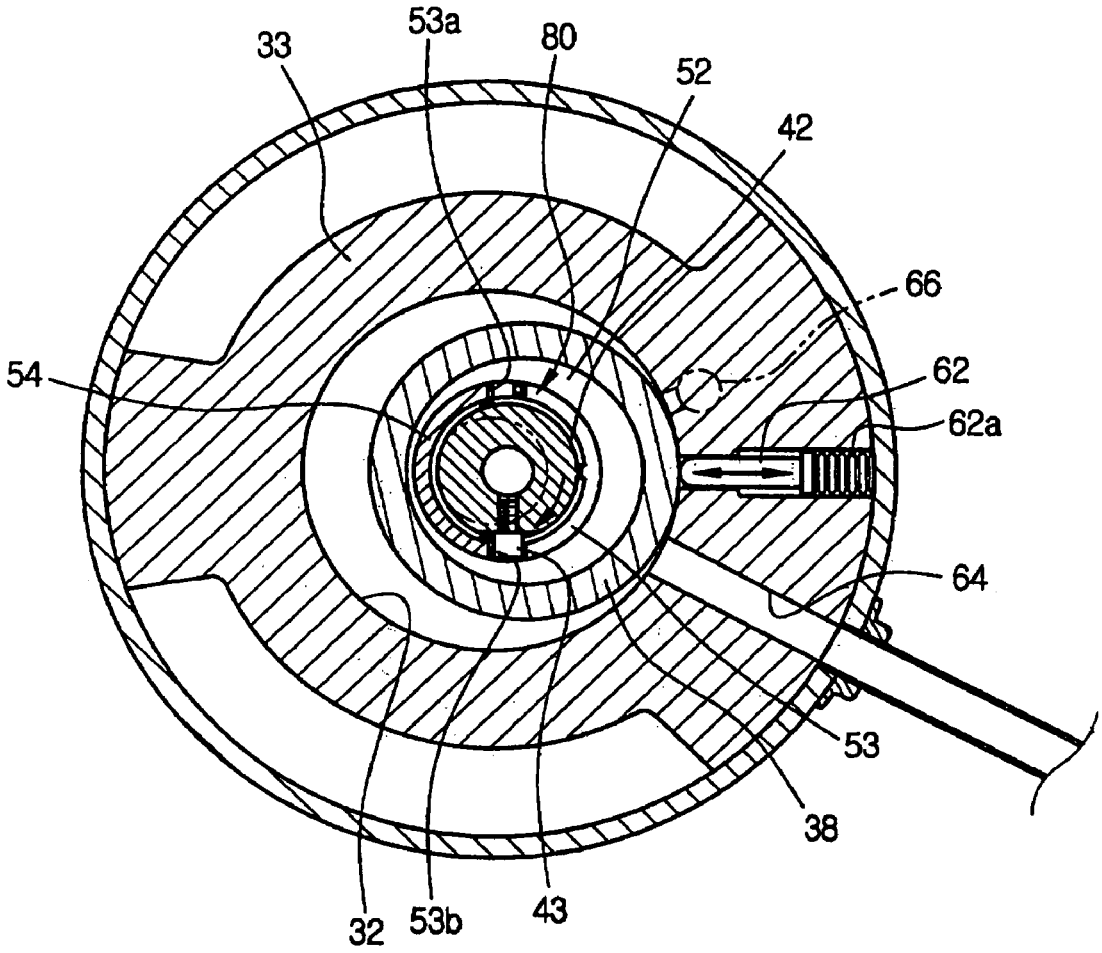
FIG. 8 is a sectional view to show the lower compression chamber where the compression operation is executed without the slippage by the eccentric unit of FIG. 2, when the rotating shaft rotates in a second direction.
Figure 9:
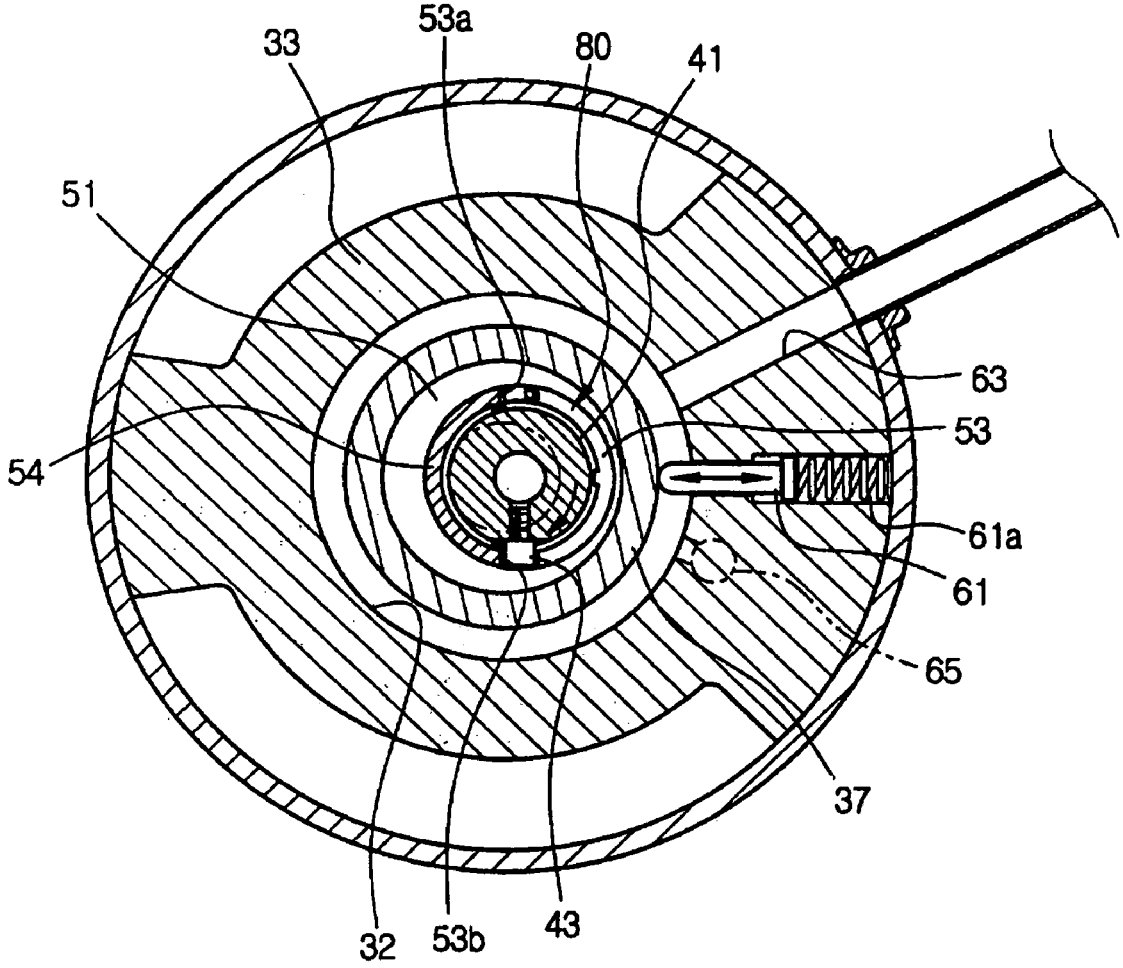
FIG. 9 is a sectional view, corresponding to FIG. 8, to show the upper compression chamber where the idle operation is executed by the eccentric unit of FIG. 2, when the rotating shaft rotates in the second direction.

FIG. 8 is a sectional view to show the lower compression chamber where the compression operation is executed without the slippage by the eccentric unit of FIG. 2, when the rotating shaft rotates in the second direction. FIG. 9 is a sectional view, corresponding to FIG. 8, to show the upper compression chamber where the idle operation is executed by the eccentric unit of FIG. 2, when the rotating shaft rotates in the second direction.

When the rotating shaft 21 rotates in the second direction to execute the compression operation in the lower compression chamber 32, the locking pin 43 which is restrained at the first end 53 of the slot 53 by the first elastic pieces 84 as shown in FIG. 5, rotates along with the rotating shaft 21. In the above state, a rotating force of the locking pin 43 acts on the first elastic pieces 84 in the second direction. Thus, as shown in FIG. 4, the first elastic pieces 84 are depressed to increase the distance between the pair of first elastic pieces 84, so that the locking pin 43 passes between the first elastic pieces 84.

As the rotating shaft 21 further rotates in such a state, the locking pin 43 rotates toward the second end 53*b* of the slot 53. Thereafter, the locking pin 43 is restrained by the second elastic pieces 85, which are provided at the positions adjacent to the second end 53*b* of the slot 53, in a same manner as the locking pin 43 is restrained by the first elastic pieces 84, which are provided at the positions adjacent to the first end 53*a* of the slot 53.

As such, when the locking pin 43 is restrained at the second end 53*b* of the slot 53 by the second elastic pieces 85, the maximum eccentric part of the lower eccentric cam 42 contacts the maximum eccentric part of the lower eccentric bush 52, and thereby the lower eccentric bush 52 rotates while being maximally eccentric from the central axis C1—C1 of the rotating shaft 21. Thus, as shown in FIG. 8, the lower roller 38 rotates while being in contact with the inner surface of the housing 33 which defines the lower compression chamber 32 to execute the compression operation.

Simultaneously, the maximum eccentric part of the upper eccentric cam 41 contacts the minimum eccentric part of the upper eccentric bush 51. The upper eccentric bush 51 rotates while being concentric with the central axis C1—C1 of the rotating shaft 21. Thus, as shown in FIG. 9, the upper roller 37 rotates while being spaced apart from the inner surface of the housing 33, which defines the upper compression chamber 31, by a predetermined interval to not execute the compression operation.

The gas refrigerant flowing to the lower compression chamber 32 through the lower inlet 64 is compressed by the lower roller 38 in the lower compression chamber 32 having a smaller capacity, and subsequently is discharged from the lower compression chamber 32 through the lower outlet 66. On the other hand, the compression operation is not executed in the upper compression chamber 31 having a larger capacity. Therefore, the rotary compressor is operated in a smaller capacity compression mode.

Meanwhile, as shown in FIG. 8, when the lower roller 38 comes into contact with the lower vane 62, the operation of compressing the gas refrigerant is completed and an operation of drawing the gas refrigerant is started. At this time, some of the compressed gas, which was not discharged from the lower compression chamber 32 through the lower outlet 66, returns to the lower compression chamber 32 and expands again to apply a pressure to the lower roller 38 and the lower eccentric bush 52 in a rotating direction of the rotating shaft 21. At this time, the lower eccentric bush 52 rotates faster than the rotating shaft 21 and causes the lower eccentric bush 52 to slip over the lower eccentric cam 42.

When the rotating shaft 21 further rotates in such a state, the locking pin 43 collides with the second end 53*b* of the slot 53 to make the lower eccentric bush 52 rotate at a same speed as that of the rotating shaft 21. Noise may be generated and the locking pin 43 and the slot 53 may be damaged, due to the collision between the locking pin 43 and the slot 53.

However, the lower eccentric bush 52 is restrained by the restraining unit 80 in a same manner as the upper eccentric bush 51 is restrained by the restraining unit 80 when the rotating shaft 21 rotates in the first direction to prevent the slippage, the collision and, as a result, the noise.

When the lower roller 38 comes into contact with the lower vane 62, some of the gas refrigerant returns to the lower compression chamber 32 through the lower outlet 66 and expands again, thus generating a pressure. The pressure acts on the lower eccentric bush 52 in the rotating direction of the rotating shaft 21 which is the second direction, thus the lower eccentric bush 52 slips over the lower eccentric cam 42. However, in a same manner as shown in FIG. 5, the locking pin 43 is restrained by the second elastic pieces 85 which are provided at positions adjacent to the second end 53*b* of the slot 53, with the elastic force which is larger than the slip-rotating force of the lower eccentric bush 52 to allow the lower eccentric bush 52 to rotate at the same speed as the rotating shaft 21 without the slippage.

As described above, when the rotating shaft 21 rotates in the first or second direction, the restraining unit 80 allows the upper or lower eccentric bush 51 or 52 to execute the compression operation in the upper or lower compression chamber 31 or 32 without the slippage.

As is apparent from the above description, the present invention provides a variable capacity rotary compressor, which is designed to execute a compression operation in either of upper and lower compression chambers having different capacities by an eccentric unit which rotates in the first or second direction to vary a compression capacity of the compressor as desired.

Further, the present invention provides a variable capacity rotary compressor, which has a restraining unit to prevent the upper or lower eccentric bush from slipping when an eccentric unit rotates in the first or second direction to allow the upper and lower eccentric bushes to rotate smoothly.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A variable capacity rotary compressor, comprising:

upper and lower compression chambers having different capacities;

a rotating shaft passing through the upper and lower compression chambers;

upper and lower eccentric cams provided on the rotating shaft;

upper and lower eccentric bushes fitted over the upper and lower eccentric cams, respectively;

a slot provided at a predetermined position between the upper and lower eccentric bushes;

a locking pin to change a position of the upper or lower eccentric bush to a maximum eccentric position, in cooperation with the slot; and a restraining unit provided at a predetermined position of the slot to restrain the locking pin with a predetermined elastic force when the locking pin is placed at a first or second end of the slot.

2. The variable capacity rotary compressor according to claim 1, wherein the restraining unit comprises at each end thereof a pair of elastic pieces which are spaced apart from each other by a predetermined interval to restrain the locking pin with the predetermined elastic force.

3. The variable capacity rotary compressor according to claim 2, wherein the restraining unit is set along an edge of the slot, and comprises:

an upper lip;

a lower lip; and a pair of connecters to connect both ends of the upper and lower lips to each other.

4. The variable capacity rotary compressor according to claim 3, wherein the pair of elastic pieces are provided at positions adjacent to each of the pair of connecters to be inwardly projected from the upper and lower lips, respectively.

5. The variable capacity rotary compressor according to claim 4, wherein the pair of elastic pieces have an elastic force which is larger than a slip-rotating force of the upper and lower eccentric bushes but is smaller than a rotating force of the rotating shaft.

6. The variable capacity rotary compressor according to claim 3, wherein the upper lip is provided with a first locking projection which is upwardly projected from an inside end of the upper lip part to be locked by the slot, and the lower lip includes a second locking projection which is downwardly projected from an inside end of the lower lip to be locked by the slot to prevent the restraining unit from being removed from the slot.

7. The variable capacity rotary compressor according to claim 3, wherein each of the pair of connecters includes a third locking projection which is rearwardly projected from an inside end of the connecter to be locked by the slot to prevent the restraining unit from being moved in a horizontal direction.

8. The variable capacity rotary compressor according to claim 3, wherein the restraining unit is fabricated through a pressing process to have a single structure.

9. The variable capacity rotary compressor according to claim 2, wherein the locking pin is provided at a predetermined position between the upper and lower eccentric cams to be projected from the rotating shaft, and the slot is provided at the predetermined position between the upper and lower eccentric bushes to receive the locking pin therein, and has a length to allow, an angle between a first line extending from the first end of the slot to a center of the rotating shaft and a second line extending from the second end of the slot to the center of the rotating shaft, to be approximately 180°.

10. A variable capacity rotary compressor, comprising:

upper and lower compression chambers having different capacities;

a rotating shaft passing through the upper and lower compression chambers;

upper and lower eccentric cams provided on the rotating shaft to be eccentric from the rotating shaft in a same direction;

upper and lower eccentric bushes fitted over the upper and lower eccentric cams, respectively, to be eccentric from the rotating shaft in opposite directions;

a slot provided at a predetermined position between the upper and lower eccentric bushes;

a locking pin to engage with a first or second end of the slot, according to a rotating direction of the rotating shaft, thus changing a position of the upper or lower eccentric bush to a maximum eccentric position; and a restraining unit set along an edge of the slot to restrain the locking pin with a predetermined elastic force when the locking pin is placed at the first or second end of the slot to allow the upper and lower bushes to rotate without slipping over the upper and lower eccentric cams.

11. The variable capacity rotary compressor according to claim 10, wherein the locking pin is provided at a predetermined position between the upper and lower eccentric cams to be projected from the rotating shaft, and the slot is provided at the predetermined position between the upper and lower eccentric bushes to receive the locking pin therein, and has a length to allow, an angle between a first line extending from the first end of the slot to a center of the rotating shaft and a second line extending from the second end of the slot to the center of the rotating shaft, to be approximately 180°.

12. The variable capacity rotary compressor according to claim 11, wherein the restraining unit is set along the edge of the slot, and comprises:

an upper lip;

a lower lip;

first and second connecters to connect both ends of the upper and lower lips to each other;

a pair of first elastic pieces provided at positions adjacent to the first connecter to be inwardly projected from the upper and lower lips, respectively; and a pair of second elastic pieces provided at positions adjacent to the second connecter to be inwardly projected from the upper and lower lips, respectively.

13. The variable capacity rotary compressor according to claim 12, wherein each of the first and second elastic pieces are projected from the upper and lower lips to be spaced apart from each other by a predetermined interval, and form curved surfaces bent toward each of the first and second connecters.

14. The variable capacity rotary compressor according to claim 12, wherein the upper lip includes a first locking projection which is upwardly projected from an inside end of the upper lip to be locked by the slot, and the lower lip is provided with a second locking projection which is downwardly projected from an inside end of the lower lip to be locked by the slot to prevent the restraining unit from being removed from the slot.

15. The variable capacity rotary compressor according to claim 12, wherein each of the first and second connecters is provided with a third locking projection which is rearwardly projected from an inside end of each of the first and second connecters to be locked by the slot to prevent the restraining unit from being moved in a horizontal direction.

16. The variable capacity rotary compressor according to claim 12, wherein each of the first and second elastic pieces has an elastic force which is larger than a slip-rotating force of the upper and lower eccentric bushes but is smaller than a rotating force of the rotating shaft.

17. A variable capacity rotary compressor, including upper and lower compression chambers, a rotating shaft passing through the upper and lower compression chambers, upper and lower eccentric cams provided on the rotating shaft, and upper and lower eccentric bushes fitted over the upper and lower eccentric cams, respectively, the rotary compressor comprising:

a slot between the upper and lower eccentric bushes;

a locking pin to cooperate with the slot to change a position of the upper or lower eccentric bushes to a maximum eccentric position; and a restraining unit to restrain the locking pin with a predetermined elastic force when the locking pin is placed at a first or second end of the slot.

* * * * *